United States Patent [19]

Ackerman

[11] 4,006,686

[45] Feb. 8, 1977

[54] BLANKET FASTENING MEANS FOR A CYLINDER BLANKET

[76] Inventor: Stephen P. Ackerman, 244 Elmwood Drive, Mundelein, Ill. 60060

[22] Filed: Sept. 18, 1975

[21] Appl. No.: 614,555

[52] U.S. Cl. ..... 101/415.1

[51] Int. Cl.[2] ..... B41F 27/12

[58] Field of Search ..... 101/415.1, 378

[56] References Cited

UNITED STATES PATENTS

| | | | |
|---|---|---|---|
| 838,790 | 12/1906 | Kneppler | 101/415.1 |
| 3,237,558 | 3/1966 | Fagg | 101/415.1 |
| 3,766,857 | 10/1973 | Schlatter | 101/415.1 |

*Primary Examiner*—Edgar S. Burr
*Assistant Examiner*—A. Heinz
*Attorney, Agent, or Firm*—James E. Nilles

[57] ABSTRACT

A blanket hooking means for use with a blanket cylinder to facilitate attachment of a blanket around the blanket cylinder with a minimum amount of effort and requiring little set-up time. The hooking means include a pair of arcuate brackets which can be secured in the blanket cylinder opening by screws which are received in pre-existing holes in the floor of the opening in the cylinder. The hooking means also includes a pair of hook members which can receive opposite ends of the blanket and cause the blanket to be securely stretched around the blanket cylinder. The hook members are slidably supported in arcuate slots in the brackets and include projections which are received in key-hole slots in the ends of the blanket. Each hook member includes a pair of adjusting screws which can be tightened so as to abut the side walls of the cylinder opening. The screws can be forced against the cylinder side walls causing an arcuate movement of the hook members in the arcuate slots and causing a tightening or stretching of the blanket around the blanket cylinder. Each adjusting screw is surrounded by a compression spring which is compressed between the hook member and the cylinder opening wall. The tension of the compression springs is sufficient to automatically compensate for any slack which may develop due to stretching of the blanket during use.

5 Claims, 7 Drawing Figures

BLANKET FASTENING MEANS FOR A CYLINDER BLANKET

BACKGROUND OF THE INVENTION

The present invention is related to blanket hooking means for use with a blanket cylinder for holding a blanket around the cylinder in order to secure the blanket thereon. More particularly, the invention is directed to a blanket hooking means which is easy to attach to a blanket cylinder and which facilitates rapid attachment of the blanket to the blanket cylinder with a minimum of effort and requiring little experience and time.

Blanket hooking or clamping means known in the prior art are shown, for example, by the patent to Kneppler, U.S. Pat. No. 838,790, issued Dec. 18, 1906 and by the patent to Graves, U.S. Pat. No. 3,062,141, issued Nov. 6, 1962. The apparatus shown in each of these patents illustrate one type of prior art blanket cylinder which includes an axially extending cylinder opening which houses the means for hooking or clamping the blanket. These prior art blanket cylinders illustrate a well known method of supporting a hooking means wherein a pair of axially extending rods which are an integral part of the blanket cylinder are employed as a means for supporting the blanket hooking mechanisms. The presence of the supporting rods in blanket cylinders of this type facilitates the use of blanket hooking means which provide a relatively satisfactory blanket hooking mechanism.

The other type of blanket cylinder which is generally used, however, is provided with a cylinder opening generally narrower than those of the first type and does not include the pair of axially extending rods. Heretofore, there has been no satisfactory hooking means provided for use with this second type of blanket cylinder. Generally these blanket cylinders employ a blanket clamping means which includes a pair of elongated clamps which are secured to the floor of the cylinder opening. The clamps each comprise a pair of elongated jaws which are held together in clamping relationship by a large number of screws. Insertion or removal of the blanket using such clamps is time consuming because all of the screws on both pairs of jaws must be removed or tightened. Clamping means of this type also have the additional disadvantage that the screw heads include hexagonal bores for receiving an allen wrench or the like and these bores collect ink residue which becomes crusted. It is thus frequently difficult to insert a wrench into the hexagonal bores to permit adjustment of the screws. Furthermore, it is not uncommon for screws used in such clamping means to work loose and to cause scoring or other damage to opposing cylinders of the printing press. A fundamental property of blankets which are generally used on the blanket cylinder is that they are generally resilient and stretch after continued use. Consequently, it was necessary with the prior art to frequently adjust the clamping means to compensate for the stretch of the blanket.

Generally it is not feasible to modify the cylinders of the second type to incorporate the blanket clamping means of the type shown in Kneppler or Graves primarily because the cylinder opening is too narrow and too shallow. Secondly, the addition of the rods to the cylinder would require disassembly of the blanket cylinder as well as costly machining.

Summary of the Invention

The present invention is directed to a blanket clamping means which can be readily adapted for use with a blanket cylinder of the type which does not include a pair of axially extending parallel rods and which provides a hooking mechanism which permits rapid installation or removal of the blanket.

The hooking means of the present invention generally includes a pair of arcuate brackets which can be bolted to the blanket cylinder quickly and easily in axially spaced relationship and further includes a pair of elongated hooking members which are slideably supported by the arcuate brackets. The hooking members each include a plurality of upwardly extending projections designed to receive key hole slots in the ends of the blanket when the blanket has been wrapped around the blanket cylinder. The hooking members are each provided with a pair of screws which can be threadably forced against the side walls of the cylinder opening to force the hooking members away from the side walls and towards each other thereby stretching the blanket around the blanket cylinder. The blanket can thus be secured to the hook members merely by placing the key hole slots over the projections and it can be stretched around the blanket cylinder by operation of only two screws.

The apparatus of the present invention thus has the advantage over the prior art of requiring less time and effort to secure and install the blanket around the blanket cylinder since only two screws need to be tightened in order to perform the installation of the blanket. The present invention also presents means for automatically compensating for any stretching of the blanket. The hooking means of the invention also has the advantages that it can be received within a narrow blanket cylinder opening and it is easy to attach to a blanket cylinder because the arcuate brackets can be secured by bolts received in pre-existing holes in the floor of the cylinder opening. Furthermore, there is no requirement that the cylinder be removed from the printing press for attachment of the hooking means and structural modification of the cylinder is unnecessary.

Further objects and advantages of the invention will become clear in the following description of the preferred embodiment. The description of the preferred embodiment which follows, merely depicts one embodiment of applicant's invention and is not limited by the particular embodiment of the invention described herein.

DESCRIPTION OF THE PREFERRED EMBODIMENT

Figure 1:
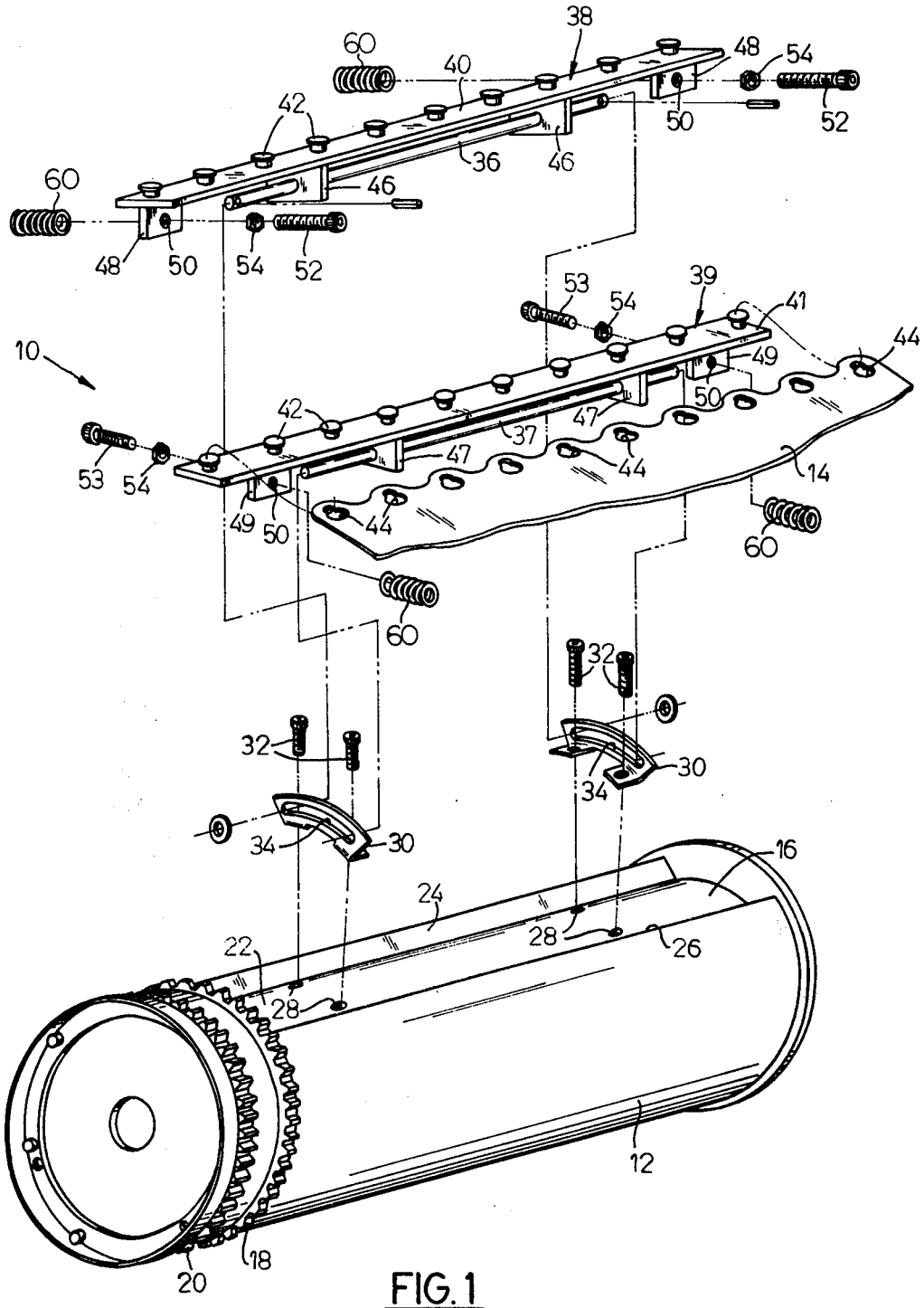
FIG. 1 is an exploded view of a blanket cylinder and the blanket fastening means of the present invention.
Figure 2:
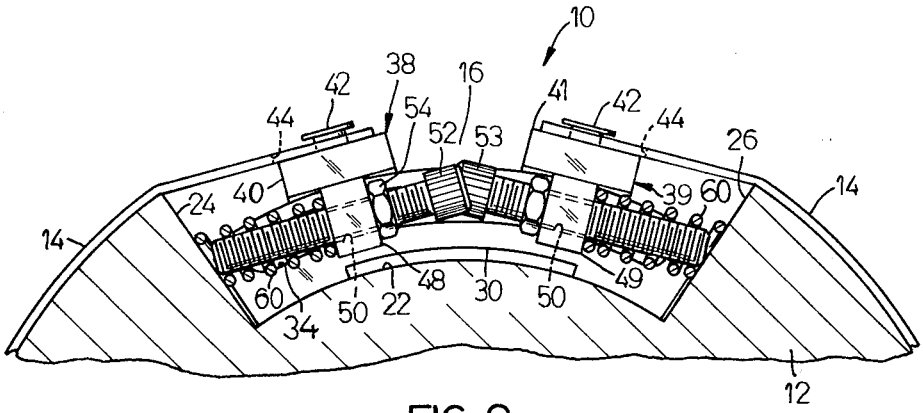
FIG. 2 is an enlarged partial cross-sectional end view of the blanket fastening means of the present invention.
Figure 3:
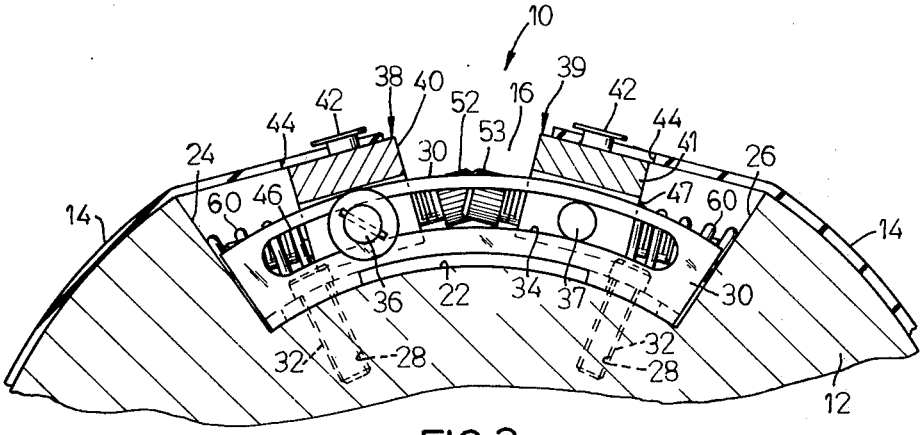
FIG. 3 is a view similar to that shown in FIG. 2 but showing the hooking member rods received in the arcuate slots of the bracket members.
Figure 4:
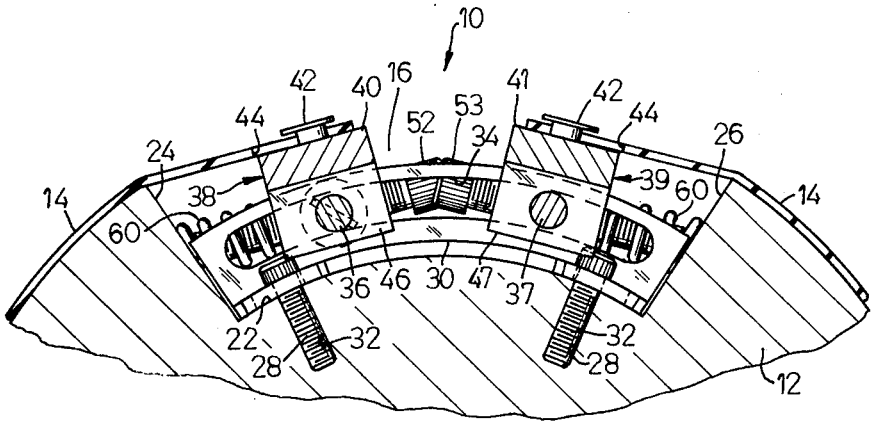
FIG. 4 is a view similar to that shown in FIGS. 2 and 3.

FIG. 1 illustrates an exploded view of the blanket hooking means 10 of the present invention and the means by which the blanket hooking means 10 is secured to a blanket cylinder 12. The blanket cylinder 12 is of the type generally used in an offset rotary printing press to support a blanket 14 formed of rubber or some other material which is capable of receiving ink from a plate cylinder and transferring that ink onto paper or the like during a printing process. The blanket cylinder 12 includes at one end, a pair of gears 18 and 20 which are receivable in meshing engagement with the impression cylinder gears and with the plate cylinder gears, respectively, of the offset press. The cylinder also includes a cylinder opening 16 having a bottom floor 22 and a pair of generally opposed side walls 24 and 26. As best shown in FIGS. 2–4, the cylinder opening is generally arcuate and the side walls 24 and 26 are disposed at an angle to each other. The bottom wall 22 includes four threaded holes 28 disposed therein for receiving the blanket hooking members to be described hereafter.

The present invention is directed to a blanket hooking assembly 10 for use with a blanket cylinder, as previously described, and which can be used to secure the cylinder blanket 14 around the blanket cylinder 12. The hooking assembly 10 includes a pair of arcuate bracket members 30 which are spaced with respect to the axis of the cylinder and which are each secured to the bottom floor 22 of the cylinder opening 16 by a pair of screws 32 which are received in the pre-existing threaded bores 28. The arcuate bracket members 30 each include an arcuate slot 34 designed to receive hooking member rods 36 and 37 as will be described.

Figure 5:
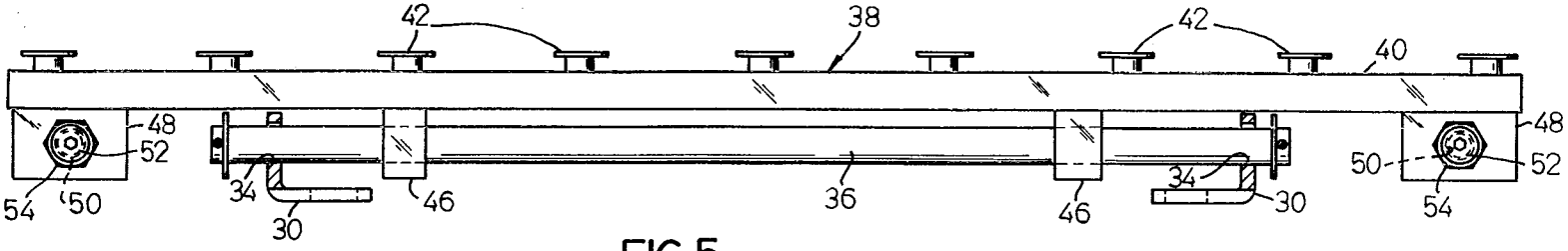
FIGS. 5 and 6 are partial cross-sectional side views of the blanket hooks of the present invention.
Figure 6:
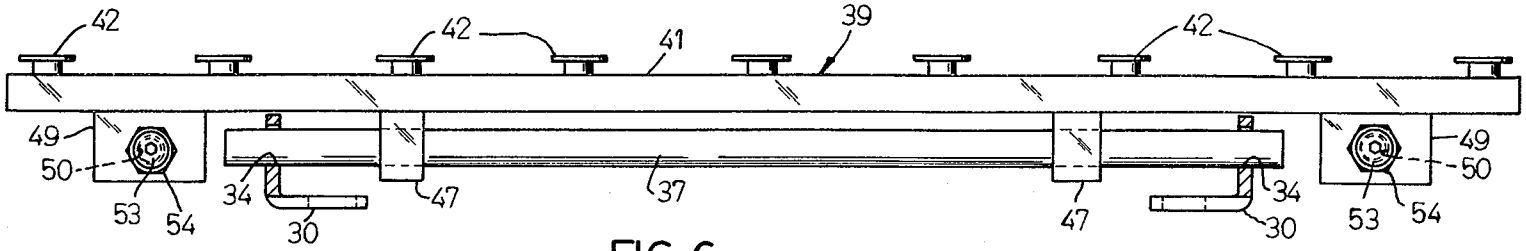
Figure 7:
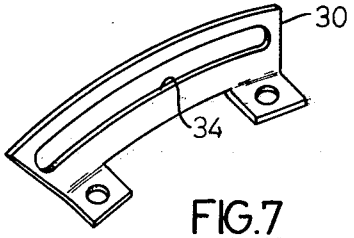
FIG. 7 is an isometric view of the brackets used to support the hooking members.

The blanket hooking means 10 further comprises a pair of hook members 38 and 39 which each engage one end of the blanket 14 and which facilitate stretching of the blanket around the blanket cylinder 12. The hook members 38 and 39 are comprised of generally elongated members 40 and 41, respectively, which support a plurality of blanket securing projections 42. The blanket securing projections 42 project upwardly from the elongated members 40 and 41 and are arranged in spaced relationship along the length of the hook members 38 and 39. The blanket securing projections 42 are designed to be received within the key hole slots 44 in the ends of the blanket 14. The hook members 38 and 39 also include pairs of downwardly extending rod brackets 46 and 47, respectively, which are integrally attached to the bottom surface of the elongated members 40 and 41 and which include aligned bores for receiving the rods 36 and 37. The clamp members 38 and 39 also include a pair of spaced integrally attached adjusting screw brackets 48 and 49, respectively, which each include a threaded bore 50 for receiving adjusting screws 52 and 53. As shown in FIGS. 5 and 6, the adjusting screw brackets 48 and 59 are disposed in staggered relationship such that the adjusting screws 52 and 53 are not in abutting relationship with each other.

Operation

The means by which the blanket 14 is attached to the hook means and the means by which the blanket is securely stretched around the blanket cylinder is best shown in FIGS. 2–4. In order to permit the blanket to be received on the blanket cylinder, the adjusting screws 52 at opposite ends of one of the hook members can be initially withdrawn to permit sliding movement of the hook member 38 in the arcuate slot 34 toward cylinder opening side wall 24. The key hole slots 44 in one end of the blanket 14 can then be placed over the projections 42 on the hook member 39 and the blanket may be wrapped around the blanket cylinder such that the key hole slots in the other end of the blanket may be received over the projections 42 on hook member 38. The adjusting screws 52 can then be tightened such that the hook member 38 is forced away from the side wall 24 and such that the blanket is stretched around the blanket cylinder. The lock nut 54 can then be tightened against the bracket 48 to secure the adjusting screw 52 in this position.

The hooking assembly of the present invention thus facilitates an uncomplicated means of securing the blanket to the blanket cylinder and avoids the substantial set-up times required with prior art apparatus, wherein a large number of screws had to be tightened to secure the blanket to the clamping means.

The hooking assembly 10 of the present invention also provides a simplified means for tightening the blanket around the blanket cylinder when the blanket stretches after substantial use. The screws 52 or 53 can be adjusted to force the associated hook member away from the side and the locking nut 54 tightened again. The screws 52 and 53 are also provided with compression springs 60 which surround the screws and are compressed between the bracket members 48 and 49 and cylinder opening side walls 24 and 26, respectively. The compression springs 60 function to automatically compensate for any stretching of the blanket caused by continued use in that they bias the hook members 38 and 39 away from the cylinder opening side walls 24 and 26 and tend to place a tensile stress on the blanket.

The hooking members of the present invention are also designed to be easy to attach to the blanket cylinder without removing the blanket cylinder from the machine and without requiring modification of the cylinder. In order to attach the hooking assembly of the present invention to the blanket cylinder it is necessary to merely bolt the arcuate bracket members 30 to the floor of the cylinder opening 16 using four screws 32 requiring very little time or experience. The holes 28 are those which have already been provided in the cylinder for securing the traditional blanket hooking means.

Resume

The present invention thus defines a blanket hooking means which can be readily attached to a blanket cylinder and which provides means for hooking a blanket around the blanket cylinder which substantially reduces the time required to attach the blanket. The present invention avoids the drawback of the prior art, wherein it was necessary to adjust a substantial number of screws in order to secure the blanket to the hooking means. The hooking means of the invention does not require the existence of axially extending rods as a means for supporting the hooking apparatus, nor does it require expensive modification of the blanket cylinder such that it can receive an adapting device.

I claim:

1. A blanket hooking means for securing a blanket around a blanket cylinder having a longitudinal axis and including a cylindrical outer surface and wherein said blanket cylinder includes a narrow elongated longitudinal cylinder opening in said cylindrical outer surface extending parallel to the axis of the cylinder and having longitudinally extending generally opposed cylinder opening walls defining generally radially extending planes with respect to the longitudinal axis of said cylinder and intersecting the cylindrical outer surface and wherein said blanket includes opposite ends and a plurality of aligned slots in said ends, said blanket hooking means comprising: bracket means removably secured to said blanket cylinder and disposed within said cylinder opening between said cylinder opening walls, a pair of elongated longitudinally extending blanket hooking members supported adjacent to said cylinder opening walls and in spaced parallel relationship to each other, at least one of said blanket hooking members being slidably supported by said bracket means for slidable movement toward and away from one of said cylinder opening walls, said hooking members including a plurality of projecting blanket securing projections aligned parallel to the longitudinal axis of said cylinder for receiving said aligned slots in the ends of said blanket, and means for adjustably forcing said at least one blanket hooking member away from said one of said cylinder opening walls for stretching said blanket around said cylinder, said bracket means including a pair of arcuate brackets received in said cylinder opening in longitudinally spaced apart relationship, said arcuate brackets each including an arcuate slot therein, and wherein said hooking members each include a rod secured thereto, said rod being slideably supported by the pair of arcuate brackets in said arcuate slots whereby each of said hooking members is slideable along said slot.

2. A blanket hooking means for securing a blanket around a blanket cylinder having a longitudinal axis and including a cylindrical outer surface and wherein said blanket cylinder includes a narrow elongated longitudinal cylinder opening in said cylindrical outer surface extending parallel to the axis of the cylinder and having longitudinally extending generally opposed cylinder opening walls defining generally radially extending planes with respect to the longitudinal axis of said cylinder and intersecting the cylindrical outer surface and wherein said blanket includes opposite ends and a plurality of aligned slots in said ends, said blanket hooking means comprising: bracket means removably secured to said blanket cylinder and disposed within said cylinder opening between said cylinder opening walls, a pair of elongated longitudinally extending blanket hooking members supported adjacent to said cylinder opening walls and in spaced parallel relationship to each other, at least one of said blanket hooking members being slidably supported by said bracket means for slidable movement toward and away from one of said cylinder opening walls, said hooking members including a plurality of projecting blanket securing projections aligned parallel to the longitudinal axis of said cylinder for receiving said aligned slots in the ends of said blanket, and means for adjustably forcing said at least one blanket hooking member away from said one of said cylinder opening walls for stretching said blanket around said cylinder, said hooking members including a plurality of projecting brackets integrally attached thereto, and wherein said bracket means include a pair of arcuate brackets, each of said arcuate brackets including arcuate slots therein, at least two of said projecting brackets including aligned bores for receiving a rod therethrough, said rod being slideably supported in said arcuate slots for movement toward and away from said cylinder opening walls.

3. The blanket hooking means set forth in claim 2, further including screw means threadably received through at least one of said brackets and receivable in abutting engagement with one of said cylinder opening walls, said screw means providing means for forcing said hooking members towards each other whereby said blanket is stretched around said blanket cylinder.

4. A blanket hooking means for securing a blanket around a blanket cylinder having a longitudinal axis and including a cylindrical outer surface, wherein said blanket cylinder includes a narrow elongated cylinder opening in said cylindrical outer surface extending parallel to the axis of the cylinder and having generally opposed longitudinally extending cylinder opening walls defining generally radially extending planes with respect to the longitudinal axis of said cylinder and intersecting the cylinder outer surface and wherein said blanket includes opposite ends and a plurality of aligned slots in each of said ends, said blanket hooking means comprising: a pair of arcuate brackets supported in said cylinder opening in longitudinally spaced apart relationship and removably secured to said blanket cylinder, said arcuate brackets each including an arcuate slot therein; a pair of elongated blanket hooking members, each of said hooking members including a rod secured thereto, said rod of each of said hooking members being received in said arcuate slots whereby said hooking members are slideably supported by said arcuate brackets, said hooking members being received in said cylinder opening in variable spaced relationship from said cylinder opening walls and in spaced parallel relationship to each other, each of said hooking members including a plurality of projecting longitudinally aligned blanket securing projections receivable within said aligned slots in the ends of said blanket and including projecting brackets; and means for adjustably forcing said blanket members away from said opposed cylinder walls for stretching said blanket around said cylinder, said means including adjusting screws threadably received through said projecting brackets and abutting said cylinder opening walls.

5. The blanket hooking means set forth in claim 4, wherein said hooking members further include a plurality of second projecting brackets integrally attached thereto, each of said second projecting brackets including aligned bores for receiving one of said rods therethrough.

* * * * *